US008623149B2

(12) United States Patent
Bettencourt

(10) Patent No.: US 8,623,149 B2
(45) Date of Patent: Jan. 7, 2014

(54) AIR WIPING DEVICE

(75) Inventor: Stephen Paul Bettencourt, Warren, RI (US)

(73) Assignee: Best Medical International, Inc., Springfield, VA (US)

( * ) Notice: Subject to any disclaimer, the term of this patent is extended or adjusted under 35 U.S.C. 154(b) by 0 days.

(21) Appl. No.: 13/531,891

(22) Filed: Jun. 25, 2012

(65) Prior Publication Data

US 2012/0260943 A1 Oct. 18, 2012

Related U.S. Application Data

(62) Division of application No. 12/689,384, filed on Jan. 19, 2010.

(51) Int. Cl.
*B08B 9/00* (2006.01)

(52) U.S. Cl.
USPC ..... 134/22.1; 134/64 R; 134/122 R; 15/309.2

(58) Field of Classification Search
USPC ..... 134/64 R, 122 R, 22.1; 15/309.2
See application file for complete search history.

(56) References Cited

U.S. PATENT DOCUMENTS

| | | | | | |
|---|---|---|---|---|---|
| 3,270,364 | A * | 9/1966 | Steele | 15/309.1 |
| 4,033,785 | A * | 7/1977 | Gibbs | 134/15 |
| 5,551,226 | A | 9/1996 | Keir et al. | |
| 5,634,236 | A * | 6/1997 | Darsey | 15/309.1 |
| 5,943,729 | A * | 8/1999 | Watkins | 15/309.1 |
| 6,267,822 | B1 * | 7/2001 | Watkins | 134/37 |
| 6,865,875 | B2 | 3/2005 | Watkins | |
| 2004/0172932 | A1 | 9/2004 | Watkins | |
| 2009/0131852 | A1 | 5/2009 | Hooi | |

* cited by examiner

*Primary Examiner* — Bibi Carrillo

(57) ABSTRACT

An air wiping device for cleaning an elongated product that passes through the air wiping device. The air wiping device includes a housing having an internal tubular passage through which the elongated product extends with the housing tubular passage having an inlet end and an outlet end for respectively receiving and passing the elongated product; a plurality of air outlets mounted in the housing and adapted to direct a flow of compressed air in a direction having a component in an opposite direction to the flow of the elongated product through the housing; and a ceramic insert disposed in the internal tubular passage of the housing and through which the elongated product passes. The ceramic insert includes a tapered input through which the elongated product is received and an output through which the elongated product passes from the housing.

1 Claim, 10 Drawing Sheets

AIR WIPING DEVICE

CROSS REFERENCE TO RELATED APPLICATION

The present application is a divisional of, and claims priority from U.S. patent application Ser. No. 12/689,384, entitled "Air whipping device"; filed on Jan. 19, 2010.

FIELD OF THE INVENTION

The present invention relates in general to an air wiping device. More particularly the present invention relates to a cleaning device for a variety of different types of products, particularly elongated members such as fiber, wiring or cabling. Even more particularly the present invention relates an air wiping device that is characterized by minimizing damage or breakage to the fiber as well as minimizing damage to the air wiping device itself.

BACKGROUND

In the manufacturing of wire, or other similar elongated products, there is a need to remove liquids and contaminants from the surface of the product. For example, in the production of wire, it is necessary that cooling fluids or cleansing acids be removed from the wire prior to spooling, storage, or subsequent processing. It is known in this art to use compressed air to remove liquid or contaminants from wire, or the like, as it passes through a tube. By way of example refer to U.S. Pat. Nos. 5,634,236 and 6,267,822, as well as an air wipe product sold by Huestis Machine Corporation of Bristol Rhode Island, and the assignee of the present invention, all of which are hereby incorporated by reference herein in their entirety. These known air wiping devices use compressed air that is vented into the tube through radially or tangentially directed holes and the liquid is removed by the force of the pressurized air traveling in the opposite direction of the moving wire. There have been numerous problems associated with past attempts to remove liquid from moving elongated members using such prior art methods.

One problem associated with known air wiping devices is that when one desires to change the cable size being processed, the entire air wipe product has to be substituted. Another problem with known air wiping devices is that in order to provide a hard surface in the inner tube of the air wiping device the entire device is usually constructed of a ceramic material as mentioned in U.S. Pat. No. 6,267,822. This makes the device expensive to manufacture. Also other devices that are used are constructed of materials that do not withstand the wear caused by the passing cable (at high speed), and thus damage to the device is common, particularly where initial misalignment occurs.

Accordingly, it is an object of the present invention to provide an improved air wiping device in which the entire air wiping device does not have to be substituted when one wants to change cable or wire size. Instead, in accordance with the present invention a separable insert is used that enables the substitution of tubing size to accommodate different size cabling or wiring. This insert substitution enables the construction of an overall less expensive device.

Another object of the present invention is to provide an improved air wiping device that is characterized by improved wear resistance. Normally the conventional air wiping device is installed in a production line and it is meant to be perfectly aligned on the central axis of the processed material. It is typical that operators may be too rushed or lazy to perform a proper alignment and thus the body wears out quickly. This usually results in the destruction of the device requiring a complete replacement of the device. However, in accordance with the improved air wiping device of the present invention the ceramic insert bore provides excellent wear resistance and compensates for misalignments. Moreover, the replaceable ceramic insert alone is less costly than the cost of a complete air wiping device.

SUMMARY OF INVENTION

To accomplish the foregoing and other objects, features and advantages of the present invention there is provided an air wiping device for cleaning an elongated product that passes through the air wiping device. The air wiping device comprises a housing having an internal tubular passage through which the elongated product extends with the housing tubular passage having an inlet end and an outlet end for respectively receiving and passing the elongated product; a plurality of air outlets mounted in the housing and adapted to direct a flow of compressed air in a direction having a component in an opposite direction to the flow of the elongated product through the housing; and a ceramic insert disposed in the internal tubular passage of the housing and through which the elongated product passes. The ceramic insert includes a tapered input through which the elongated product is received and an output through which the elongated product passes from the housing. The ceramic insert provides an extremely durable work surface for the elongated product.

In accordance with other aspects of the present invention the housing is separated into two housing sections and the housing sections are preferably connected by a hinge that biases the housing sections to a closed position; the plurality of air outlets comprise nozzles that are disposed about a 360 degree locus; the ceramic insert is comprised of a pair of insert sections. The housing section includes a first housing section and a second housing section, the pair of insert sections including a first insert section and a second insert section, the first insert section mounted in the first housing section and the second insert section mounted in the second housing sections; including separate fastener means for removably attaching the respective insert sections to the housing sections; each of the insert sections and housing sections are substantially semicircular in shape; and the fasteners retain the insert sections in place in the elongated tubular passage and together define an inner passage through which the elongated product passes.

In accordance with another version of the present invention there is provided an air wiping device for cleaning an elongated product that passes through the air wiping device. The air wiping device comprises: a housing having an elongated internal tubular passage; said housing including first and second housing sections that together define the elongated internal tubular passage; a hinge that couples together the first and second housing sections and biases the housing sections to a closed position in which the elongated internal tubular passage is formed; a plurality of nozzles mounted in the housing and adapted to direct a flow of compressed air in a direction having a component in an opposite direction to the flow of the elongated product through the housing; said plurality of nozzles including a first set of nozzles mounted in the first housing section and a second set of nozzles mounted in the second housing section; and a ceramic insert disposed in the internal tubular passage of the housing and through which the elongated product passes; said ceramic insert including a first insert section supported by the first housing section and a second insert section supported by the second housing section; and said ceramic insert sections defining a tapered input through which the elongated product is received and an output through which the elongated product passes from the housing.

In accordance with other aspects of the present invention the plurality of nozzles are disposed about a 360 degree locus; including a mounting bracket for the housing that mounts the housing in a manner by which the housing may still move toward an open position should an object associated with the elongated product engage the tapered input so as to avoid damage to the device; the housing sections include a slot that is used for the support of the housing from the bracket; including separate fastener means for attaching the respective insert sections to the housing sections; each of the insert sections and housing sections are substantially semi-circular in shape; the fasteners retain the insert sections in place in the elongated tubular passage and together define an inner passage through which the elongated product passes; and the fasteners removably attach the insert sections so that other insert sections may be substituted.

In accordance with the present invention there is also provided a method of cleaning an elongated product by passing the elongated product through an air wiping device, and in which the air wiping device includes, a housing having an internal tubular passage through which the elongated product extends; a plurality of air outlets mounted in the housing and adapted to direct a flow of compressed air in a direction having a component in an opposite direction to the flow of the elongated product through the housing and a ceramic insert disposed in the internal tubular passage of the housing and through which the elongated product passes, said method including the steps of: removably mounting a first ceramic insert in the housing so as to accommodate a first size elongated product; after usage, removing the first ceramic insert; and substituting a second ceramic insert in the housing so as to accommodate a second size elongated product.

DESCRIPTION OF THE DRAWINGS

Numerous other objects, features and advantages can be realized in accordance with the present invention by referring to the accompanying drawings, in which.

DETAILED DESCRIPTION

Reference is now made to the present preferred embodiment of the present invention which is illustrated in the accompanying drawings. The device of the present invention removes particulate matter or other adherent material from an elongated member such as wiring or cabling. The device will effectively remove any material loosely adhered to the elongated member such as liquids, particulate solids, contaminants or combinations thereof. Although it shows particular utility in removing liquids or other materials from elongated solids such as wires or cables, the principles of the present invention may also apply to cleaning any number of other elongated substances.

In accordance with the present invention, the device generally includes a housing having a chamber with a plurality of air inlets for receiving compressed air into the chamber, a central tube for receiving an elongated member as it is traveling into the chamber, and an exit for allowing the elongated member to leave the chamber. Furthermore, the compressed air is generally expelled (with removed material) through the central tube.

Figure 1:
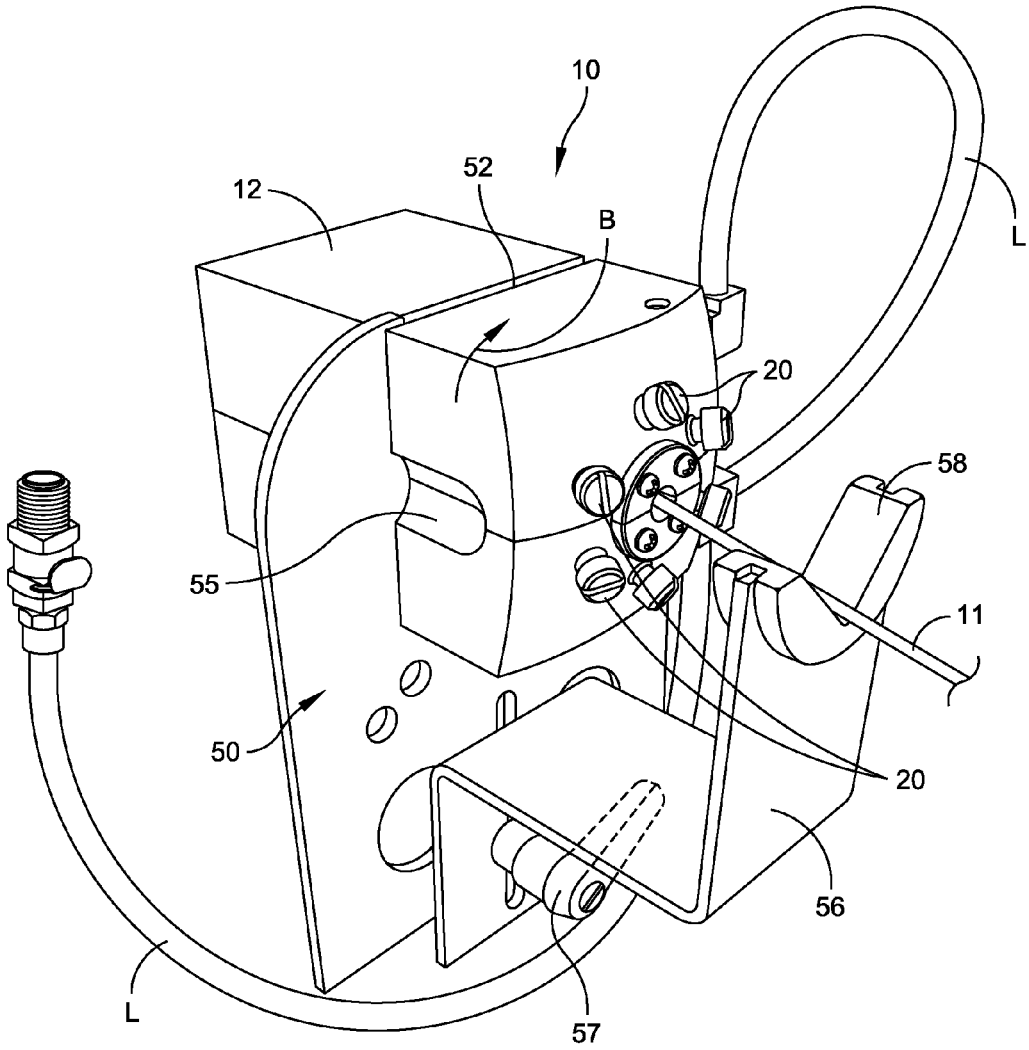
FIG. 1 is a perspective view of one embodiment of the air wiping device constructed in accordance with the principles of the present invention and illustrated as supported from a mounting bracket.
Figure 8:
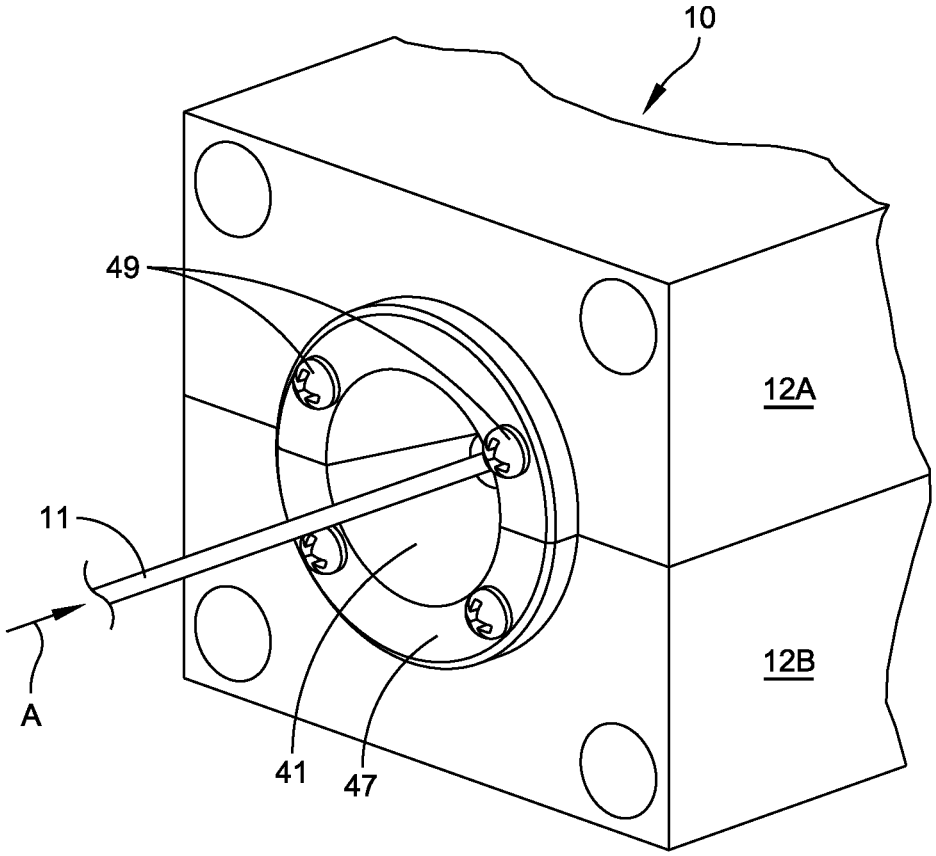
FIG. 8 is a fragmentary perspective view at the left side of the device.
Figure 9:
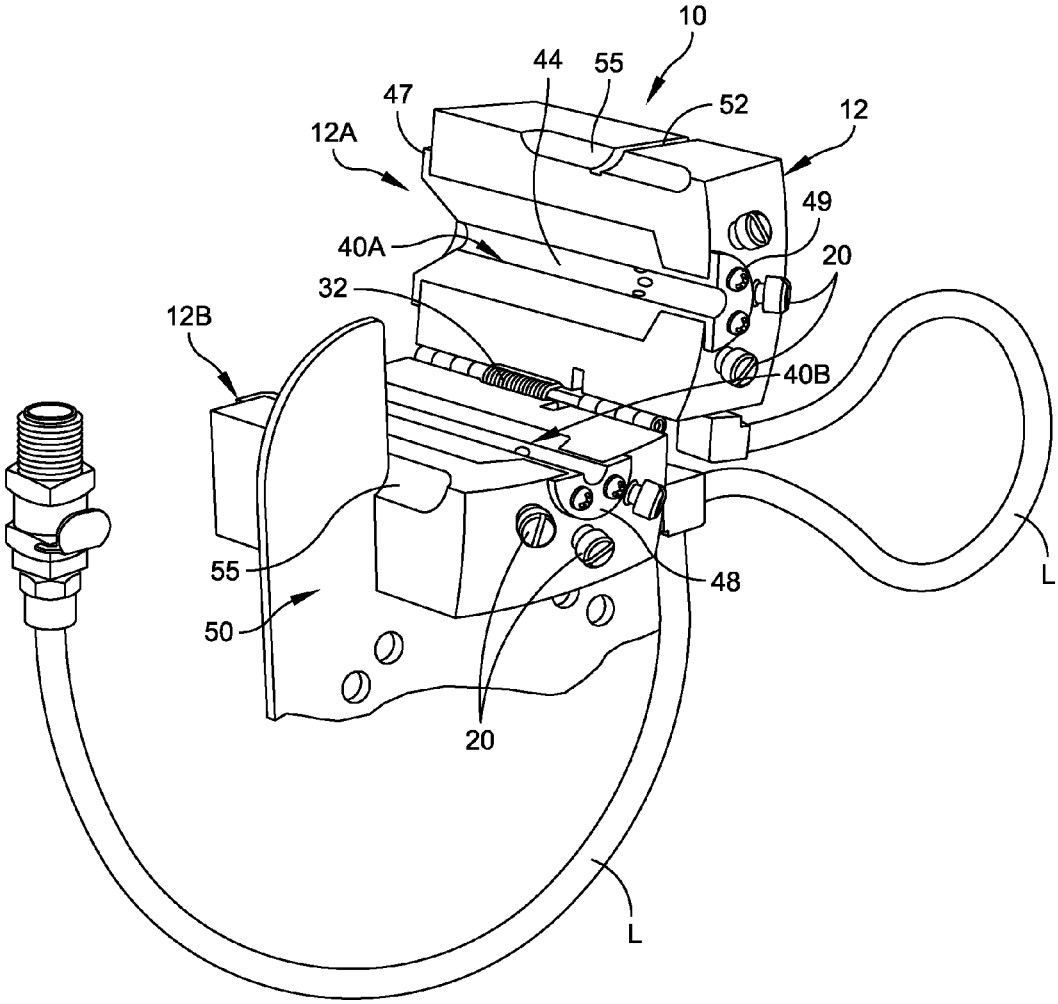
FIG. 9 is a perspective view of the device of FIG. 1 with the housing in an open position.

As here embodied and depicted in the drawings, there is shown an air wiping device designated by the numeral 10. The device 10 is used to remove liquid and/or other materials from an elongated member 11 having a generally circular cross-sectional area and moving in the direction of the arrows A illustrated in FIGS. 3, 6 and 8. Additionally, air wiping device 10 is meant to be used in conjunction with a compressed air delivering system (not shown). Part of the delivery system is shown in FIGS. 1 and 9 by the air lines L. Device 10 includes housing 12 having an internal plenum chamber 14 into which the compressed air is coupled from the lines L.

The chamber 14 couples the compressed air to the plurality of nozzles 20. The nozzles 20 are each meant to provide a jet stream of air or any other gas directed to the elongated product as the elongated product or member is conveyed through the air wiping device.

Figure 4:
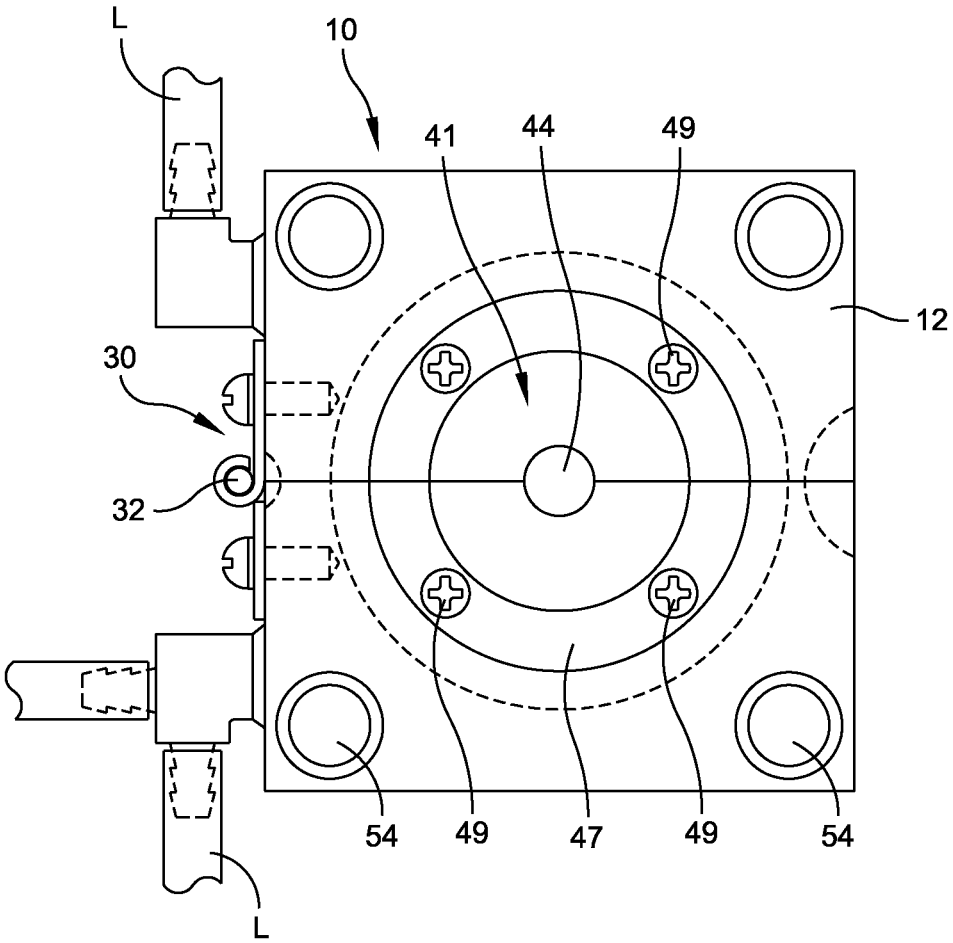
FIG. 4 is a left side view of the air wiping device of FIG. 1.

Reference is now made to the perspective view of FIG. 1 that illustrates the air wiping device 10 of the present invention as supported by the bracket 50. Refer also to the partial perspective view of FIG. 9 which shows a portion of the bracket 50. The bracket supports the device 10 primarily by means of an engagement of the planar-shaped bracket 50 with the slot 52. From FIG. 9 it is noted that the bracket 50 is open at its top end so that the housing 12 can move from a closed position as illustrated in FIG. 1 to an open position as illustrated in FIG. 9. A pair of spring loaded ball plungers engage mating holes in the bracket providing too less unit removal from the bracket or securing screws may be used for securing the housing to the bracket. This is illustrated in FIG. 4 wherein passages 54 may accommodate securing screws that may be spring loaded and have ends that are urged against the planar surface of the bracket 50.

The bracket 50 may also support a further bracket 56 whose position relative to the bracket 50 is adjustable by means of a knob 57. A top end of the bracket 56 supports a guide piece 58 through which the elongated member may be supported and extend. The guide piece 58 is preferably constructed of a hard material such as a ceramic material.

The housing 12 is illustrated as being formed in two sections with a common depression 55 that provides a gripping surface for opening the two sections of the housing against the bias of a supporting spring. FIG. 1 also illustrates by arrow B the direction of opening of a top housing section relative to a bottom housing section.

Figure 3:
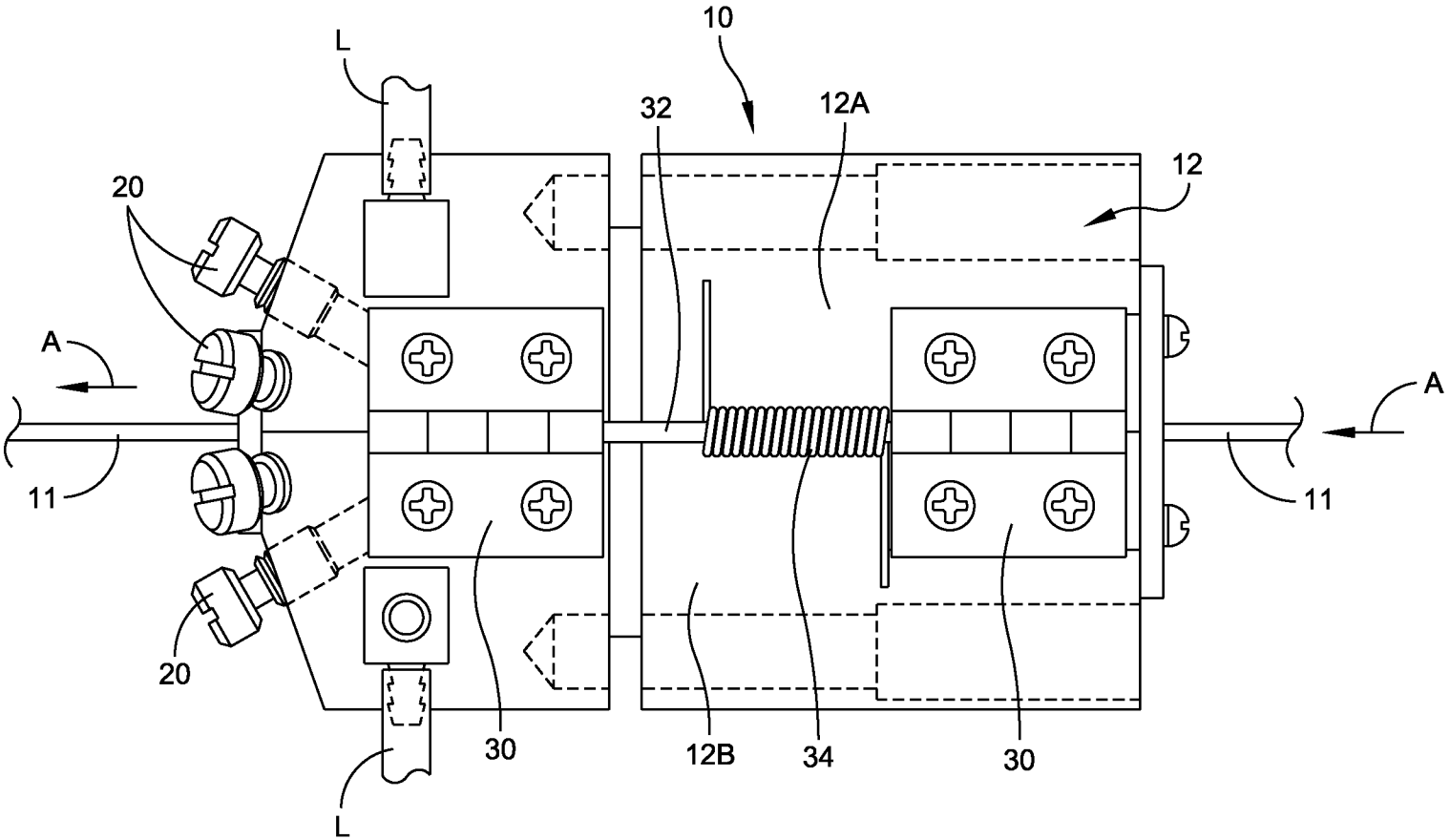
FIG. 3 is a rear view of the air wiping device of FIG. 1.

The housing 12 is considered as separated into two like housing sections identified as sections 12A and 12B in the drawings. These two sections are interconnected by means of a hinge arrangement that is best illustrated in FIG. 3. This includes hinge plates 30, hinge pin 32 and biasing spring 34.

The hinge pin 32 extends between the hinge plates 30 and the biasing spring 34 is wound about the hinge pin 32. This arrangement biases the two housing sections to a closed position such as the one illustrated in FIG. 1.

Figure 2:
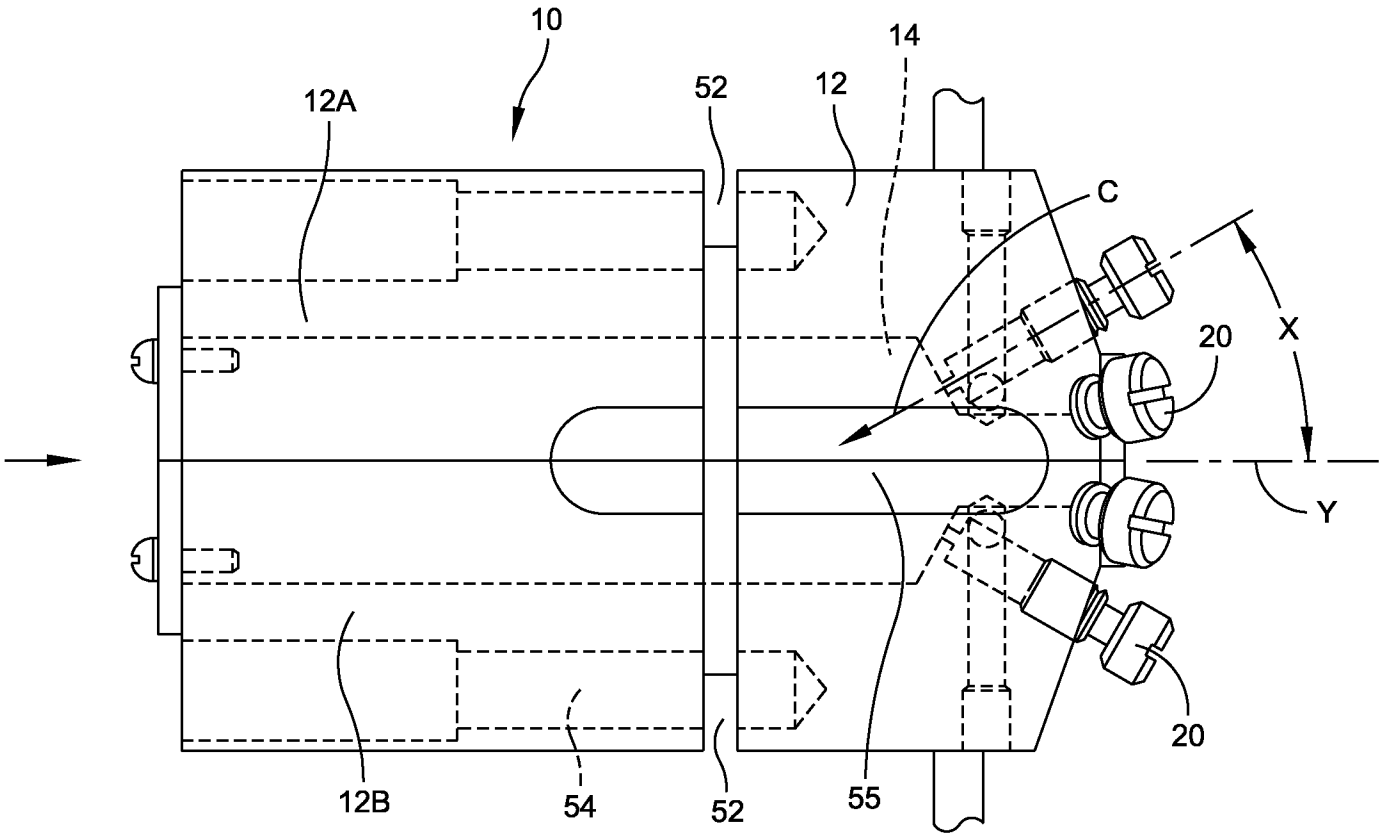
FIG. 2 is a front view of the air wiping device of FIG. 1.
Figure 6:
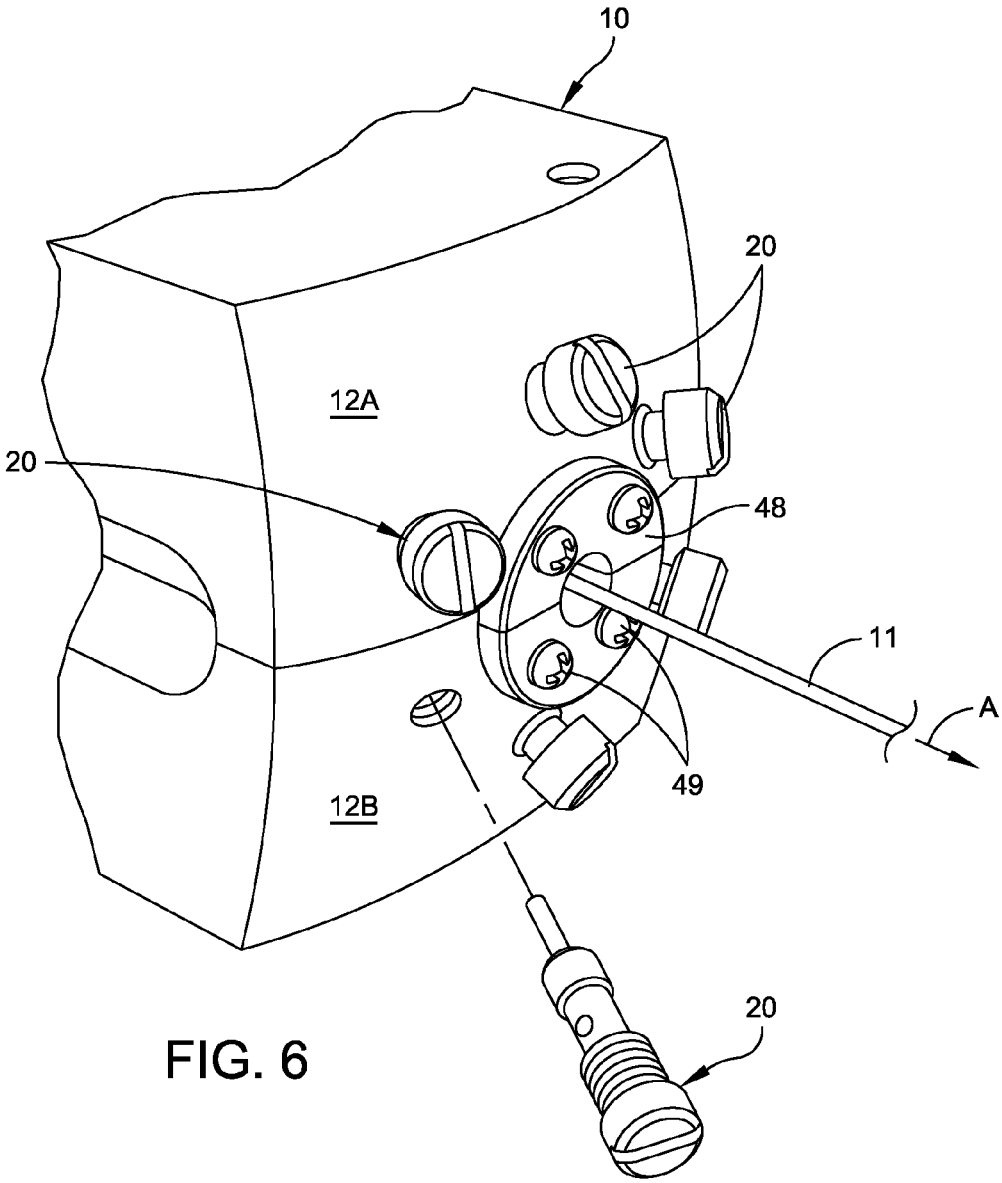
FIG. 6 is a fragmentary perspective view at the right side of the device and showing the nozzle exploded from the housing.
Figure 7:
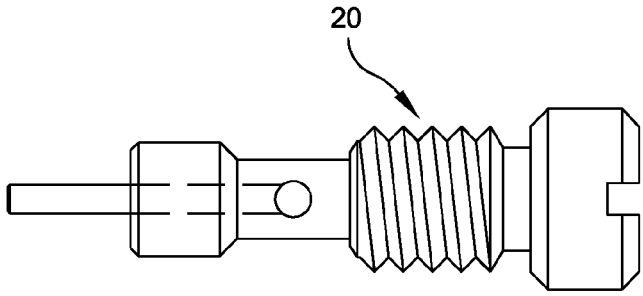
FIG. 7 is an illustration of the nozzle.

FIG. 2 illustrates the position of the nozzles 20. These nozzles are adapted to be screwed into the respective housing sections with their being provided in the disclosed embodiment three nozzles for each of the housing sections. In this regard refer to FIG. 5 that shows the three separate nozzles associated with respective housing sections 12A and 12B. Refer also to FIG. 2 which shows the nozzles 20 coupling to the plenum chamber 14. Refer also to FIGS. 6 and 7. FIG. 7 in particular illustrates the construction of the nozzle 20 which includes a head, a threaded section and a port through which the compressed air passes. The nozzles are disposed so as to direct compressed air from an input plenum to an elongated internal tubular passage. The nozzles 20 may be of conventional design.

Figure 10:
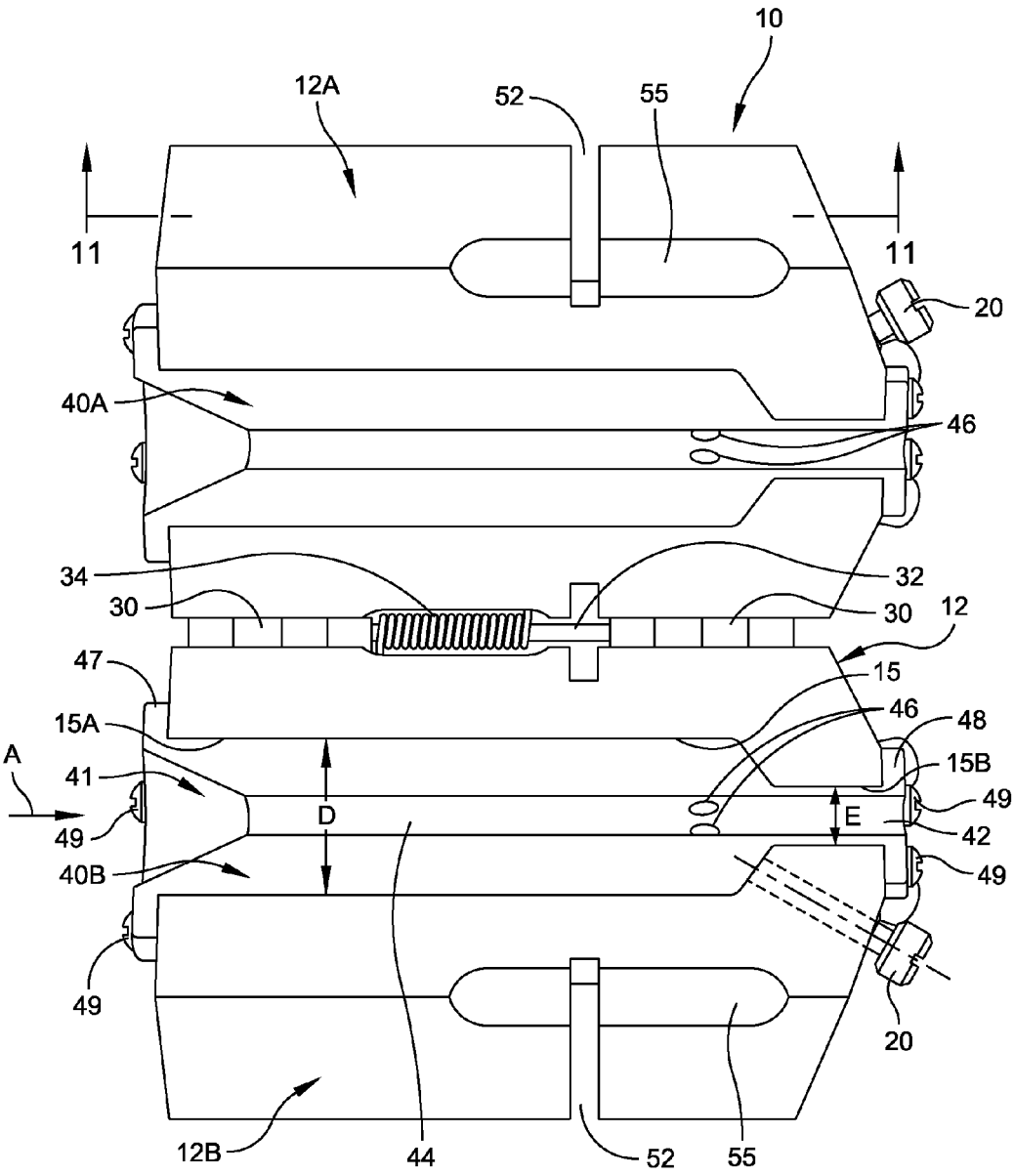
FIG. 10 is a front view with the housing open.
Figure 11:
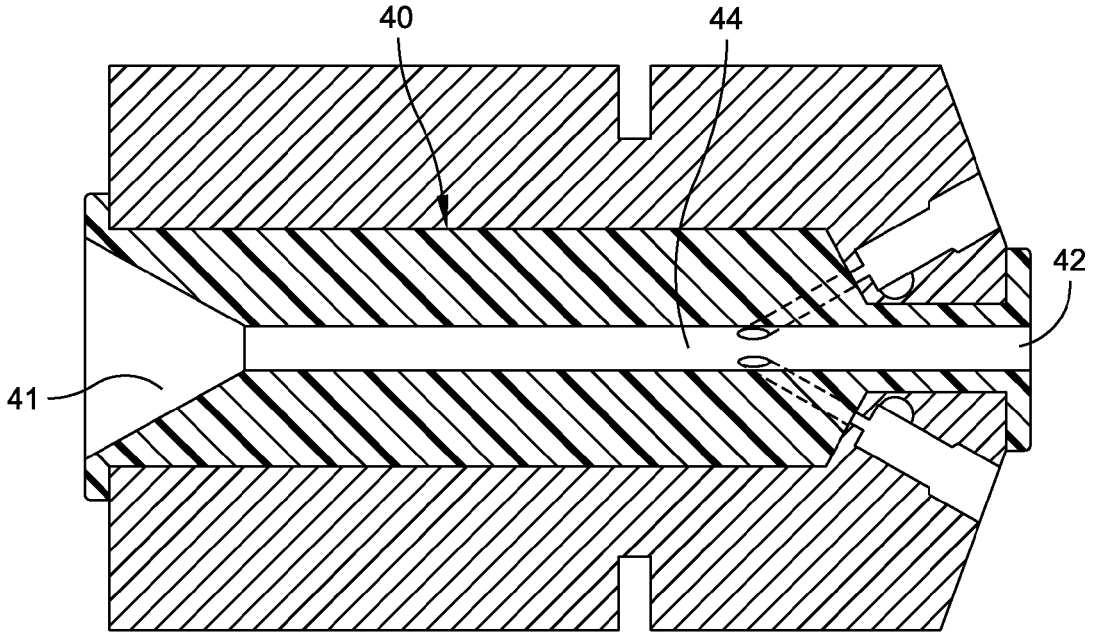
FIG. 11 is a cross-section through one of the ceramic insert sections.

FIG. 10 illustrates the general shape of this internal passage which is adapted to receive the insert of the present invention. This internal passage 15 has a larger diameter section at 15A and a substantially smaller diameter section at 15B. It is noted that the smaller diameter section 10 15B is at the location where the nozzles direct compressed air to the tubular passage. A fluid passage is formed through each nozzle body to the tip of the nozzle to enable a flow of a fluid medium therethrough. A series of fluid passages associated with the plenum 14 may be used to connect the entry chamber with each of the individual spray nozzles. As indicated previously, there are three nozzles associated with each housing section. However, in other embodiments of the invention, fewer or greater numbers of nozzles associated with each section may be provided. These nozzles are generally situated around a 360 degree locus.

An air or other fluid medium supply valve may be associated with the housing and is connected to a fluid supply medium which is not specifically shown herein, other than the indication of compressed air lines L. The fluid medium or air is supplied to the plenum under pressure and may flow through the plenum into the individual channels directing the compressed air to each of the individual spray nozzles. The spray nozzles inject the fluid spray under pressure into the central tubular passage and against the elongated member that is being conveyed through the air wiping device. The fluid jets from the nozzles are directed in the direction of arrow C as depicted in FIG. 2. This direction is counter to and at an angle to the direction of movement of the wire 11 as the wire 11 progresses through the center passage, such as shown in FIG. 3 by the arrow A. The fluid stream may be applied against the wiring typically in a range of pressure of from 10 to 30 pounds per square inch or compressed air pressure from 10 to 100 pounds per square inch.

The application of the compressed air stream is under pressure sufficient to dislodge or blow off any collected dust, particulate matter or other contaminants that might cling to the wiring. This dislodged matter is urged in the opposite direction to the normal flow of the wiring through the air wiping device. As a result, as the wiring exits the housing through the output end of the device, the fiber has been cleaned substantially. As illustrated in, for example, FIGS. 2 and 3, the nozzles 20 are disposed at an angle X to the longitudinal axis Y. This angle X is preferably less than 45 degrees and is preferably in a range of 15-60 degrees to the longitudinal axis Y.

Now, in accordance with the present invention, there is provided a ceramic insert which is probably best illustrated in FIGS. 9 and 10. This insert is generally referred to by the reference number 40 and in, for example, FIGS. 9 and 10, the insert is shown as separated into two insert sections 40A and 40B. Each of the insert sections is substantially identical in shape and contour in the embodiment disclosed herein. The outer surface of each of the inserts is configured to match the tubular passage within the associated housing section.

With reference to, for example, FIG. 10 and the ceramic insert section 40B, as with the other insert sections, there is included a tapered input 41 and an output at 42, a constant diameter center passage 44 extends between the tapered input 41 and the output 42. The elongated member being processed passes at a particular speed through the center passage 44. The ceramic insert also has a larger diameter shown at D and a smaller diameter at E. There is also a transition between these two diameters D and E. The reduced diameter portion is important in minimizing the amount of ceramic material adjacent to the output end so that the nozzles 20 located at that area can more directly couple compressed air into the passage 44. For this purpose, as noted in FIG. 10, there are a series of ports 46, one associated with each of the nozzles 20. In the present embodiment wherein there are three nozzles in each of the housing sections, then there would be three corresponding ports 46. It is noted that the ceramic insert section 40A is also provided with similar ports, illustrated at 46. FIG. 10 also illustrates by arrow A the direction of passing of the elongated member. It is noted that the ports 46 are directed at an angle having a component that is opposite to the direction of travel of the elongated member.

Each of the ceramic insert sections also include an inlet flange 47 and an outlet flange 48. Fasteners 49 are used for attaching each of the ceramic insert sections at their respective flanges 47 and 48. Refer also to the left and right side views shown in respective FIGS. 4 and 5 for further illustrations of the flanges and the securing fasteners.

Figure 5:
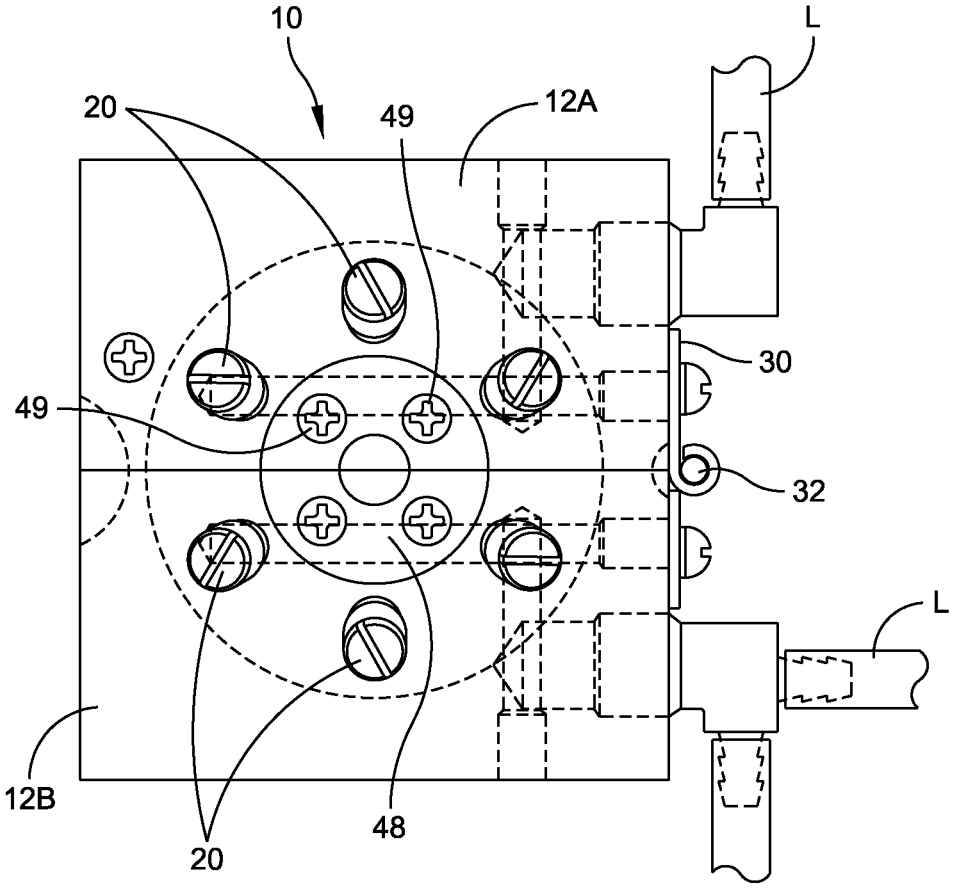
FIG. 5 is a right side view of the air wiping device of FIG. 1.

Each of the ceramic inserts when used with a particular wire or cable will have semicircular passages that correspond so that once these are mated together when the housing is in a closed position, such as illustrated in FIGS. 4 and 5, a completed circular passage exists for receiving the elongated member. In order to substitute a different ceramic insert, one simply removes the fasteners and likewise removes each of the ceramic insert sections. Then, one can substitute another and different set of insert sections. A different set of insert sections may be used, for example, when accommodating a different size wire or cabling.

Having now described a limited number of embodiments of the present invention, it should now be apparent to one skilled in the art that numerous other embodiments and modifications thereof are contemplated as falling within the scope of the present invention.

What is claimed is:

1. A method of cleaning an elongated product, comprising the steps of:

providing a housing having first and second housing sections that together define an internal tubular passage, wherein the first and second housing sections are connected by a spring-biased hinge;

providing a first set of nozzles mounted in the first housing section;

providing a second set of nozzles mounted in the second housing section, wherein said first set and said second set of nozzles are disposed about a 360 locus so as to direct a flow of compressed air to said internal tubular passage;

providing a ceramic insert having first and second ceramic insert sections disposed removably in and extending through the internal tubular passage of the housing and through which the elongated product passes, the ceramic insert having ports corresponding to the first and second set of nozzles mounted in the housing;

mounting the first ceramic insert section in the first housing section and mounting the second ceramic insert section in the second housing section by urging the two housing sections apart towards the spring-biased hinge in order to dispose in the tubular passage of the housing the ceramic insert;

coupling the first and second housing sections together using the spring biased hinge to form the internal tubular passage;

passing an elongated product through the ceramic insert extending through the internal tubular passage of the housing; and directing the compressed air through the first and second set of nozzles in the housing to the ports in the ceramic insert to clean the elongated product.

* * * * *